US005954039A

United States Patent [19]

Doering et al.

[11] Patent Number: 5,954,039

[45] Date of Patent: Sep. 21, 1999

[54] AIR/FUEL RATIO CONTROL SYSTEM

[75] Inventors: Jeffrey Allen Doering, Canton; Allan Joseph Kotwicki, Williamsburg; Brent Edward Sealy, Dearborn, all of Mich.

[73] Assignee: Ford Global Technologies, Inc., Dearborn, Mich.

[21] Appl. No.: 09/053,217

[22] Filed: Apr. 1, 1998

[51] Int. Cl.[6] ..... F02D 41/14

[52] U.S. Cl. ..... 123/692; 123/691; 123/681; 123/672; 123/687

[58] Field of Search ..... 123/692, 691, 123/681, 672, 687, 696

[56] References Cited

U.S. PATENT DOCUMENTS 5,213,088 5/1993 Harada ..... 123/692
5,228,287 7/1993 Kuronishi et al. ..... 123/692
5,279,114 1/1994 Kurita et al. ..... 123/692
5,462,038 10/1995 Kotwicki et al. ..... 123/692
5,511,377 4/1996 Kotwicki ..... 123/692

*Primary Examiner*—Willis R. Wolfe
*Assistant Examiner*—Mahmoud M. Gimie
*Attorney, Agent, or Firm*—Allan J. Lippa

[57] ABSTRACT

An air/fuel control system (8) and method for an engine (28) having two engine banks coupled to a single catalytic converter (50) uses first and second exhaust gas oxygen sensors (44, 55) coupled to respective first and second exhaust manifolds (56, 57) and various engine operating parameters. During a first set of engine operating conditions, air/fuel control system (8) maintains the exhaust air/fuel ratio oscillations of the two bank in phase with one another. During a second set of engine operating conditions, air/fuel control system (8) maintains the exhaust air/fuel ratio oscillations of the two bank 180 degrees out of phase with one another. When transitioning, emission impacts are minimized.

12 Claims, 5 Drawing Sheets

AIR/FUEL RATIO CONTROL SYSTEM

FIELD OF THE INVENTION

The invention relates to air/fuel ratio control systems responsive to an exhaust gas oxygen sensor coupled to each cylinder group of an engine.

BACKGROUND OF THE INVENTION

Engine control systems utilize a measurement of exhaust gas to maintain an average air to fuel (air/fuel) ratio around a desired value. When two state exhaust gas oxygen sensors are used, a typical result is a fluctuation, or oscillation, of the exhaust air/fuel ratio around the desired value. When the exhaust system includes a conventional three way catalytic converter, these oscillations are beneficial to reducing regulated emissions.

In systems where the engine contains dual cylinder banks, each coupled to separate catalytic converters, and each bank is capable of independent air fuel control, the oscillations of the exhaust air/fuel ratio are made to be in phase of one another. By maintaining the oscillations in phase, the catalytic converter efficiency is increased and regulated emissions are reduced. Such a system is disclosed in U.S. Pat. No. 5,511,377.

In systems where the engine contains dual cylinder banks each coupled to separate catalytic converters, and each bank is capable of independent air fuel control, the oscillations of the exhaust air/fuel are made to be out of phase of one another. By maintaining the oscillations out of phase, torque fluctuations are minimized with no efficiency effect on either of the two catalytic converters. Also, because there are two separate catalytic converters, the relative phase does not effect emissions. Such a system is disclosed in U.S. Pat. No. 5,462,038.

The inventors herein have recognized numerous problems with the above approaches. For example, in systems containing a dual bank engine connected to a single catalytic converter, idle quality is severely effected by the torque fluctuations when the air/fuel ratio of each bank is forced to oscillate in phase. Further, a system containing two catalytic converters is much more costly to manufacture and produce, thus lowering customer value.

SUMMARY OF THE INVENTION

An object of the invention claimed herein is to provide an engine air/fuel ratio control system for an engine containing separate banks coupled to a single catalytic converter capable of maintaining the banks of the engine either in phase or out of phase and making a transition between the two depending on the state of the engine operating conditions.

The above object is achieved, and problems of prior approaches overcome, by the method shown in claim 1. In one particular aspect of the invention, the method comprises controlling air/fuel ratio of the first group of engine cylinders to oscillate about a desired air/fuel ratio; controlling air/fuel ratio of the second group of engine cylinders to oscillate about the desired air/fuel ratio; operating the air/fuel ratio oscillations of the first and second group of engine cylinders in phase when a first set operating conditions are detected; and operating the air/fuel ratio oscillations of the first and second group of engine cylinders out of phase when a second set operating conditions are detected.

Operating the engine banks in phase during certain conditions where torque fluctuations are unnoticeable by a driver will maximize catalyst efficiency. Operating the engine banks out of phase during conditions where exhaust flow is low, and thus emissions impacts are minimized, will maximize driver comfort and quality perception. Because conditions where exhaust flow is low correlate to conditions where driver perception is maximum, these goals are not mutually exclusive. Thus an advantage of the above aspect of the invention is that the catalytic converter efficiency is maximized for operating conditions where torque fluctuations are unnoticeable and torque fluctuations are minimized where the effect on catalytic converter efficiency is insignificant. It is therefore possible to optimize both emissions and driver comfort in an engine system containing dual banks with a single catalytic converter.

Another advantage of the present invention is the ability to transfer from one phase to another with minimal effects on the exhaust air/fuel ratio.

Yet a further advantage of the present invention is the ability to minimize regulated emissions emitted during the transition from one phase to another.

Other objects, features and advantages of the present invention will be readily appreciated by the reader of this specification.

BRIEF DESCRIPTION OF THE DRAWINGS

The object and advantages described herein will be more fully understood by reading an example of an embodiment in which the invention is used to advantage, referred to herein as the Description of the Preferred Embodiment, with reference to the drawings wherein.

DESCRIPTION OF AN EMBODIMENT

Figure 1:
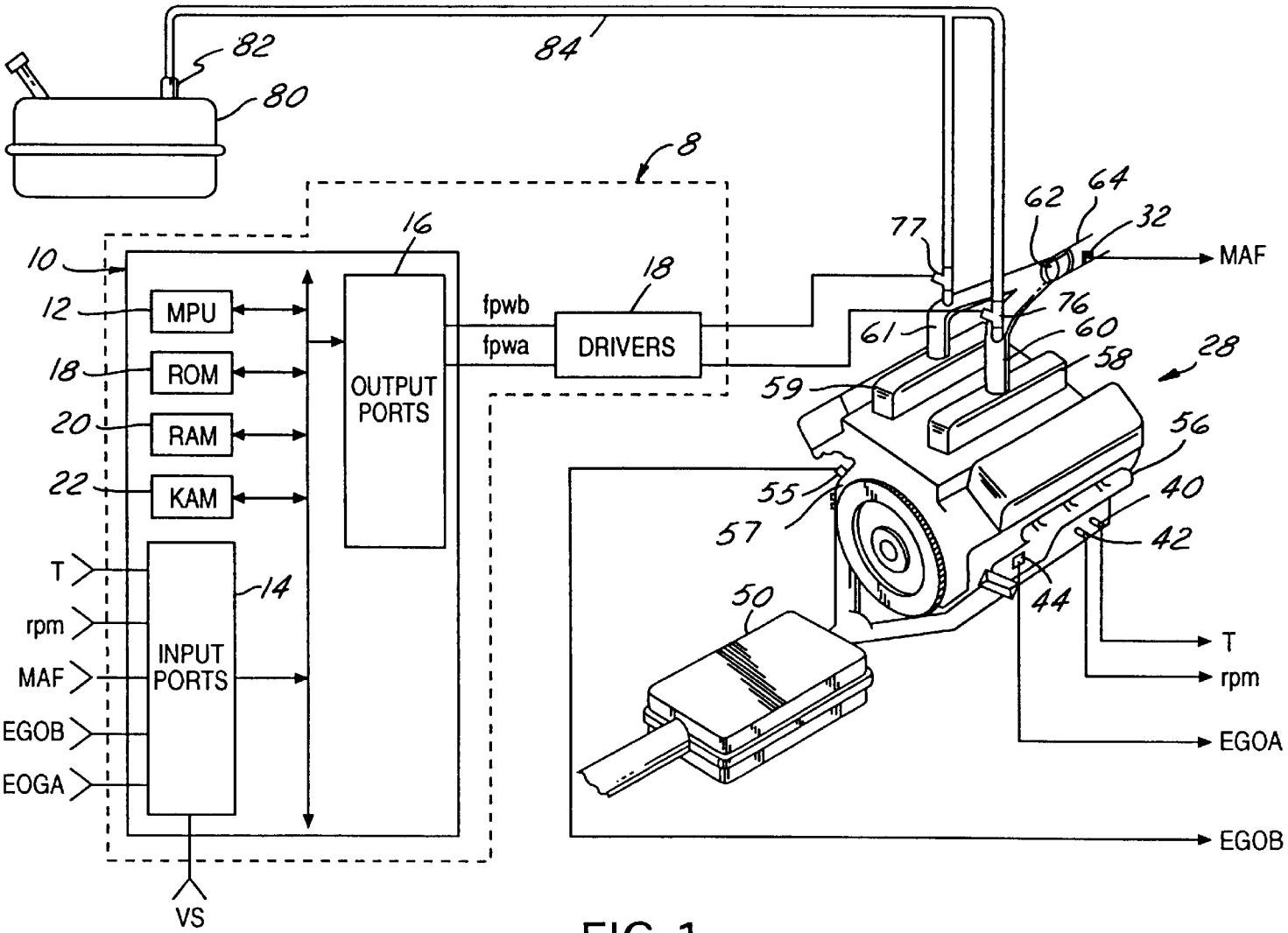
FIG. 1 is a block diagram of an embodiment wherein the invention is used to advantage.

Controller 8 of FIG. 1 is shown having conventional microcomputer 10 including: microprocessor unit 12; input ports 14; output ports 16; read only memory 18, for storing the controlled program; random access memory 20, for temporary data storage which may also be used for counters or timers; keep alive memory 22, for storing learned values; and a conventional data buss. Outputs of microcomputer 10 are shown coupled to conventional electronic drivers 17.

Various signals from sensors coupled to engine 28 are shown coupled to controller including: measurement of inducted mass air flow (MAF) from air flow sensor 32, engine coolant temperature (T) from temperature sensor 40; vehicle speed sensor (VS) from conventional vehicle speed sensor (not shown); and indication of engine speed (RPM) from tachometer 42.

Output signal EGOA is provided from conventional exhaust gas oxygen sensor 44 coupled to right-hand exhaust manifold 56 which, in this particular example, is coupled to the right-hand cylinder bank of a V-8 engine. Similarly, output signal EGOB is shown provided by conventional exhaust gas oxygen sensor 55 coupled to left-hand exhaust manifold 57.

Intake manifold 58 and intake manifold 59 are respectively coupled to the right-hand cylinder bank and left-hand cylinder bank of engine 28 and are also shown communicating with respective throttle body 60 and throttle body 61. Each throttle body in turn is shown connected to single air intake 64. Throttle plate 62 and mass air flow sensor 32 are shown coupled to air intake 64.

Continuing with FIG. 1, conventional electronic fuel injectors 76 and 77 are shown coupled to respective throttle body 60 and throttle body 61. Fuel injectors 76 delivers fuel in proportion to the pulse width of signal fpwa from controller 8 via one of the conventional electronic drivers 17. Similarly, fuel injector 77 delivers fuel in proportion to the pulse width of signal fpwb from controller 8 via one of the electronic drivers 17. Fuel is delivered to fuel injectors 76 and 77 by a conventional fuel system including fuel tank 80, fuel pump 82, and fuel rail 84.

Those skilled in the art will recognize that although a central fuel injected (CFI) system is shown for each cylinder bank, the invention claimed herein is also applicable to other fuel delivery systems such as those having a separate fuel injector coupled to each cylinder and carbureted systems. It is also recognized that the invention is applicable to other engine and exhaust gas oxygen sensors such as a separate sensor coupled to a plurality of combustion sensors in an in-line engine. Further, the invention is applicable to sensors other than two-state sensors such as proportional sensors.

Figure 2:
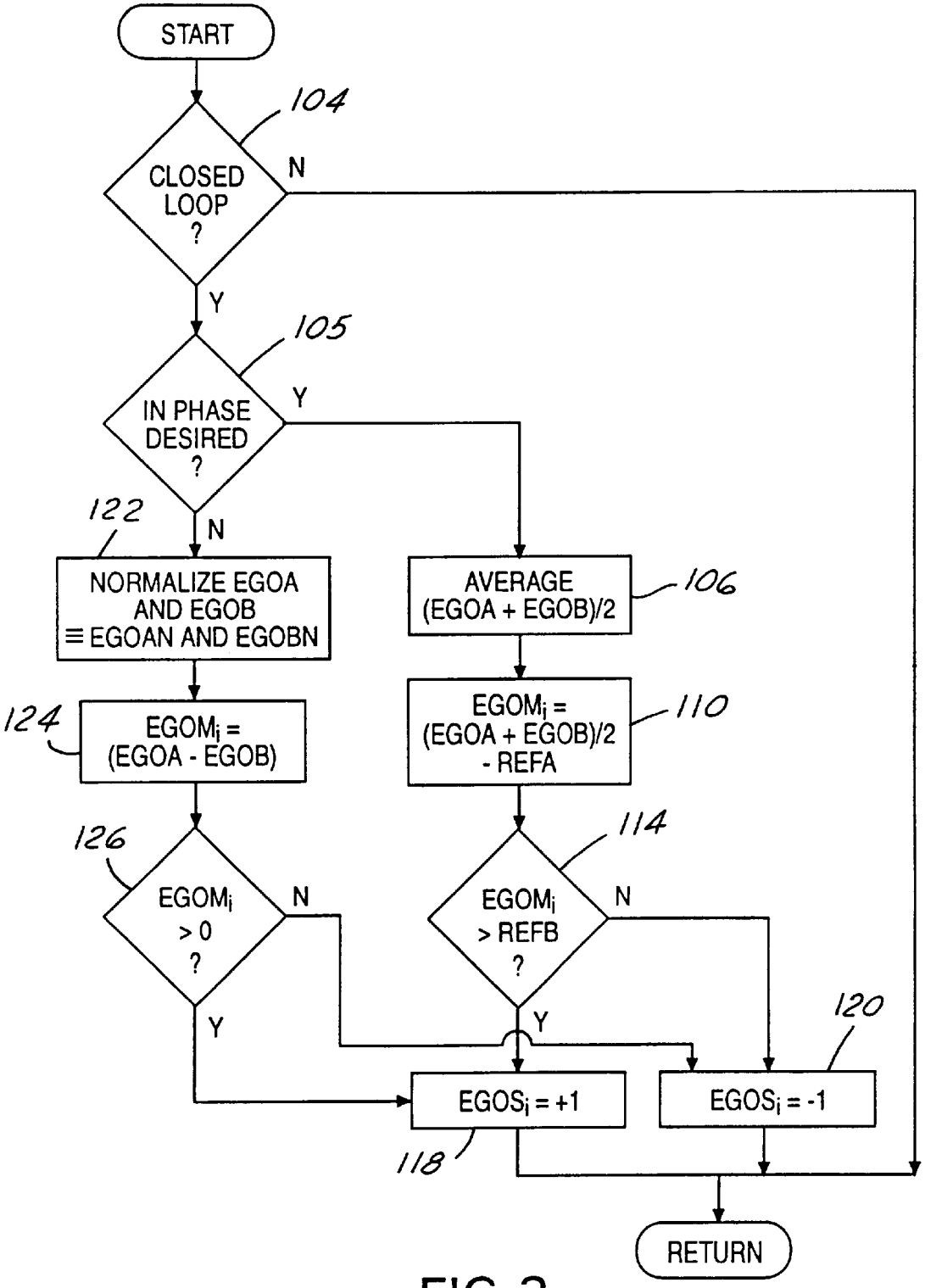
FIGS. 2, 3A–3B, 4–5, 6A–6B and 7–8 are high level flow charts of various operations performed by a portion of the embodiment shown in FIG. 1.

Referring now to FIG. 2, a flowchart of a routine performed by controller 8 to generate two-state signal $EGOS_i$ each background loop or sample period (i) is now described. The routine is entered after closed-loop air/fuel control is commenced (step 104) in response to preselected operating conditions such as engine temperature. When closed-loop control commences, a determination is made as to whether in phase or out of phase is desired (step 105) as described later herein with particular reference to FIG. 7. When in phase operation is desired, signal EGOA and signal EGOB from respective exhaust gas oxygen sensors 44 and 55 are sampled and averaged (step 106). Each sample period (i), signal $EGOM_i$ is generated by subtracting reference value REFA from the averaged sensor signals (step 110). When signal $EGOM_i$ is greater than reference value REFB (step 114), signal $EGOS_i$ is set equal to a predetermined positive value such as one volt (step 118). An indication is thereby provided that the average sensor output is rich of a desired air/fuel ratio such as stoichiometry. On the other hand, when $EGOM_i$ is less than reference value REFB as shown in step 114, signal $EGOS_i$ is set equal to a negative value such as minus one volt. An indication is thereby provided that the averaged sensor output is lean of a desired air/fuel ratio such as stoichiometry.

When out of phase operation is desired, signal EGOA and signal EGOB from respective exhaust gas oxygen sensors 44 and 55 are sampled and normalized (step 122). After normalization, respective signals EGOAN and EGOBN provide a positive predetermined output state and a negative predetermined output state when exhaust gases are rich or lean of stoichiometry, respectively.

Each sample period (i), signal $EGOM_i$ is generated by subtracting signal EGOBN from signal EGOAN (step 124). When signal $EGOM_i$ is greater than reference value O (step 126), signal $EGOS_i$ is set equal to a predetermined positive value such as one volt (step 118). On the other hand, when $EGOM_i$ is less than reference value O as shown in step 126, signal $EGOS_i$ is set equal to a negative value such as minus one volt.

Figure 3A:
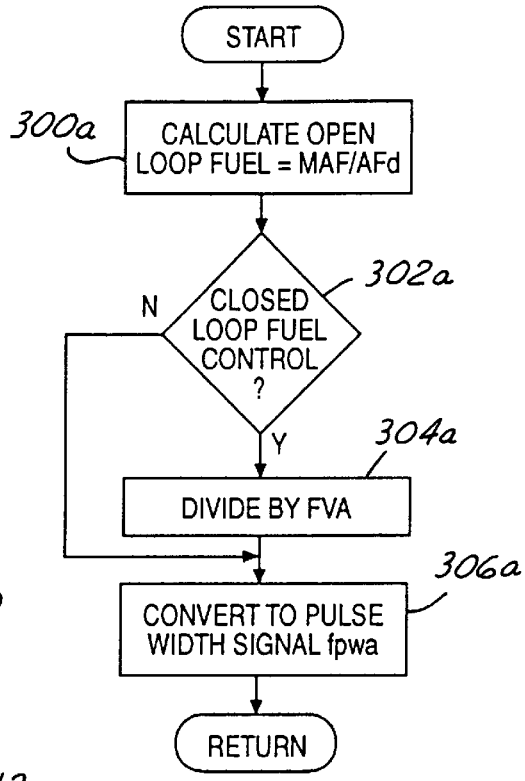
Figure 3B:
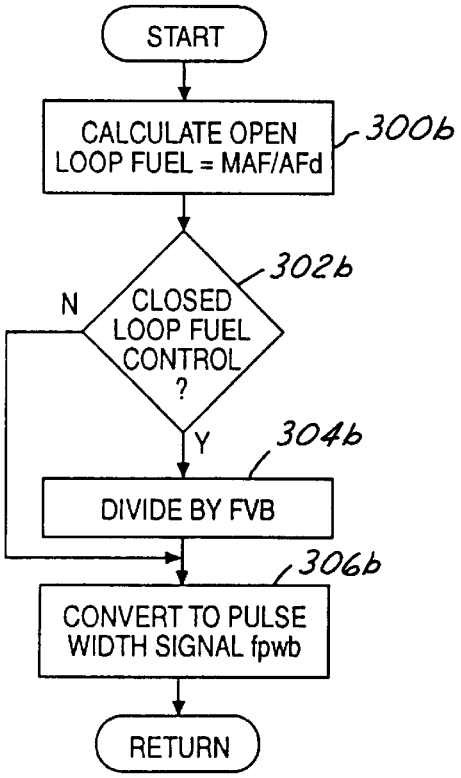

A flowchart of the liquid fuel delivery routine executed by controller 8 for controlling engine 28 is now described beginning with reference to the flowcharts shown in FIGS. 3A and 3B. FIG. 3A describes fuel delivery to the right engine bank of engine 28 and FIG. 3B describes fuel delivery for the left bank of engine 28.

In FIG. 3A, an open-loop calculation of desired liquid fuel is shown calculated in step 300*a*. More specifically, the measurement of inducted mass airflow (MAF) from sensor 32 is divided by desired air/fuel ratio AFd which in this particular example is the stoichiometric air/fuel ratio. After determination is made that closed-loop or feedback control is desired (step 302*a*), the open-loop fuel calculation is trimmed by fuel feedback variable FVA to generate the desired fuel signal during step 304*a*. This desired fuel signal is converted into fuel pulse width signal fpwa for actuating fuel injector 76 (FIG. 1) coupled to the right-hand engine bank.

In a similar matter, fuel pulse width fpwb is generated in FIG. 3B wherein like numerals refer to like steps shown in FIG. 3A. In the routine shown in FIG. 3B, the open-loop fuel calculation is divided by feedback signal FVB to generate fuel pulse width signal fpwb for the left-hand engine bank of engine 28.

Figure 4:
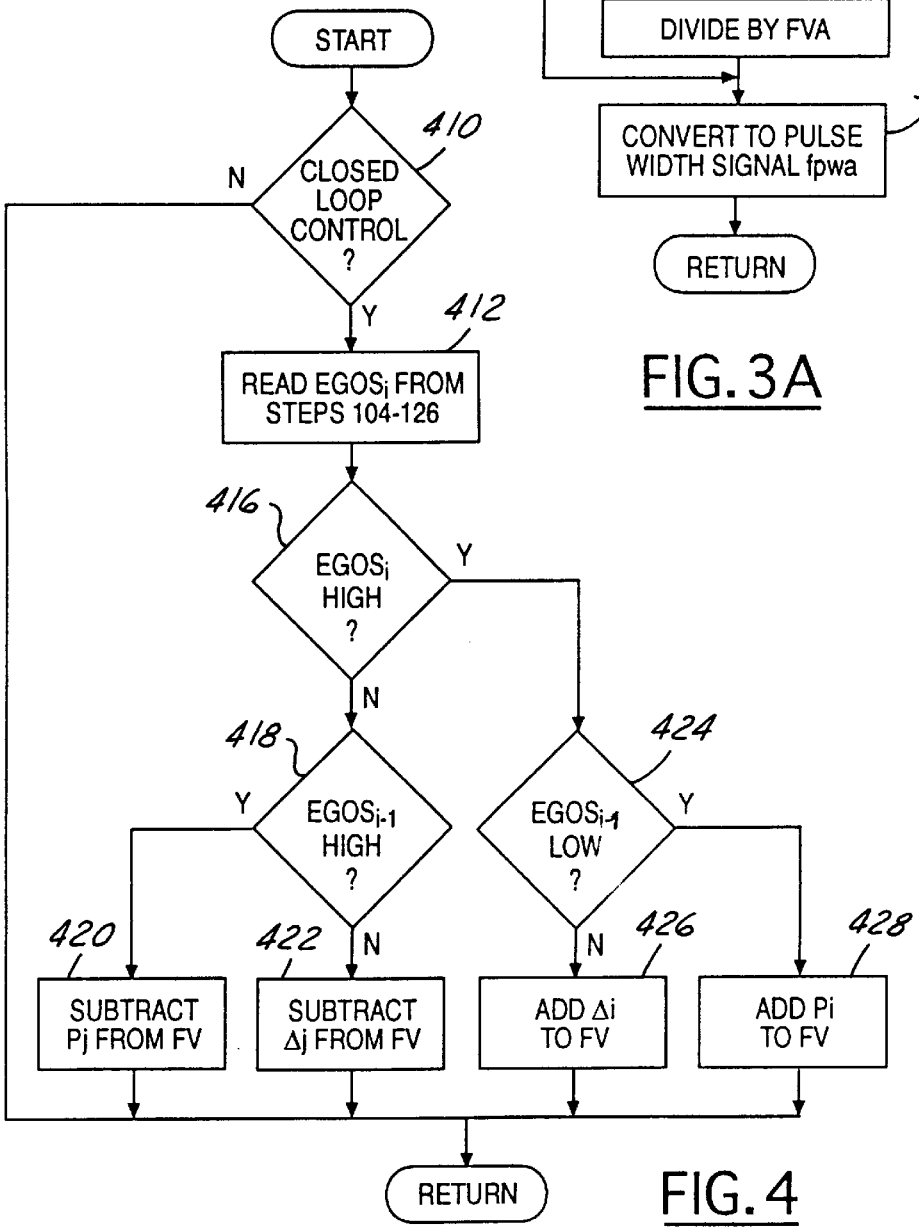

In general, feedback signal FVA and feedback signal FVB are each generated from feedback signal FV as described in greater detail later herein with particular reference to FIGS. 6A and 6B. The routine for generating feedback signal FV is now described with reference to FIG. 4.

After closed-loop fuel control is commenced (step 410), signal $EGOS_i$ is read during sample time (i) from the routine previously described with respect to steps 104–126 shown in FIG. 2. When signal $EGOS_i$ is low (step 416), but was high during the previous sample time or background loop (i−1) of controller 8 (step 418), preselected proportional term Pj is subtracted from feedback variable FV (step 420). When signal $EGOS_i$ is low (step 416), and was also low during the previous sample time (step 418), preselected integral term Dj is subtracted from feedback variable FV (step 422).

Similarly, when signal $EGOS_i$ is high (step 416), and was also high during the previous sample period (step 424), integral term Di is added to feedback variable FV (step 426). When signal $EGOS_i$ is high (step 416), but was low during the previous sample time (step 424), proportional term Pi is added to feedback variable FV (step 428).

Figure 5:
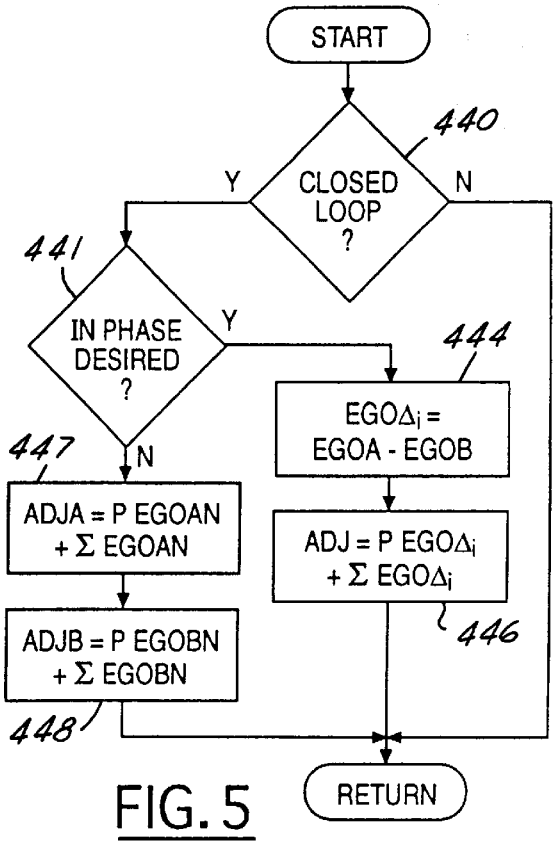

The routine for generating adjustment signal ADJ is now described with reference to the routine shown in FIG. 5. After closed-loop air/fuel control is determined in step 440, and when in phase operation is desire (step 441) the difference between signal EGOA and signal EGOB from respective right exhaust manifold EGO sensor 44 and left exhaust manifold EGO sensor 55 is calculated to generate signal $EGOD_i$ (step 444). Adjustment signal ADJ is then generated by processing signal $EGOD_i$ in a proportional plus integral controller (step 446). More specifically, adjustment signal ADJ is generated by multiply proportional term "P" times signal $EGOD_i$ each sample period (i). The resulting product is then added to the integral of signal $EGOD_i$ each sample period (i).

Alternatively, when out of phase operation is desired, adjustment signal ADJA and adjustment signal ADJB are generated for respective right hand and left hand engine banks. Adjustment signal ADJA is generated by processing signal EGOA in a proportional plus integral controller (step 447). More specifically, adjustment signal ADJA is generated by multiplying proportional term "P" times signal EGOAN each sample period (i). The resulting product is then added to the integral of signal EGOAN each sample period (i). Similarly, adjustment signal ADJB is generated by processing signal EGOBN in a proportional plus integral controller at 448. Each sample period (i), proportional term "P" is multiplied by signal EGOB. The resultant product is then added to the integral of signal EGOBN each sample period (i) as shown in step 448.

Figure 6A:
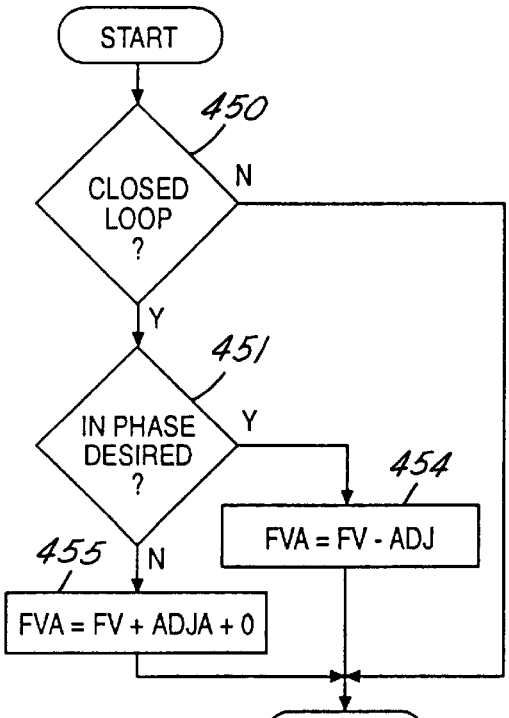

Feedback signal FVA for correcting the right cylinder bank of engine 28 is generated by the routine illustrated in FIG. 6A. More specifically, when controller 8 is in closed-loop fuel control (step 450), and in phase operation is desired (step 451), feedback signal FVA is generated by adding adjustment signal ADJ to feedback signal FV (step 454). Alternatively, when out of phase operation is desired, feedback signal FVA is generated by adding adjustment signal ADJA and reference value O to feedback signal FV (step 455).

Figure 6B:
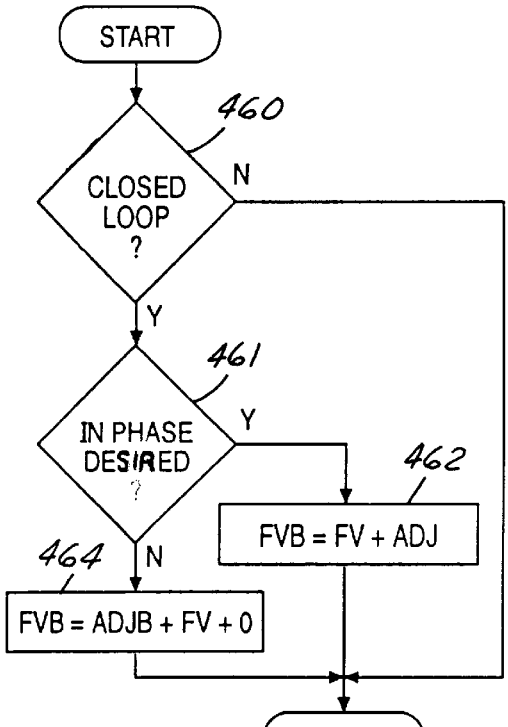

Similarly, feedback signal FVB for the left cylinder bank of engine 28 is generated by the routine shown in FIG. 6B. When closed-loop air/fuel control is commenced (step 460) and in phase operation is desired (step 461), feedback signal FVB is generated by subtracting adjustment signal ADJ from feedback signal FV (step 462). Alternatively, when closed-loop air/fuel control is commenced and out of phase operation is desired, feedback signal FVB is generated by adding an inverse of feedback signal FV, adjustment signal ADJB, and reference value O (step 464).

As discussed previously herein with particular reference to FIGS. 3A, feedback signal FVA trims the open-loop fuel calculation to maintain the right cylinder bank of engine 28 at, on average, a desired air/fuel ratio during closed-loop fuel control. Similarly, as previously described with reference to FIG. 3B, during closed-loop fuel control, feedback signal FVB trims the open-loop fuel delivery calculation to maintain the left cylinder bank at a desired, average air/fuel ratio.

An advantageous effect of the operation described above is that when desired, transitions in the air/fuel ratio of each engine bank are operated 180° out of phase with each other thereby minimizing torque fluctuation. Another advantageous effect of the operation described above is that when desired, transitions in the air/fuel ratio of each engine bank are in phase with each other thereby maximizing catalytic converter efficiency.

Figure 7:
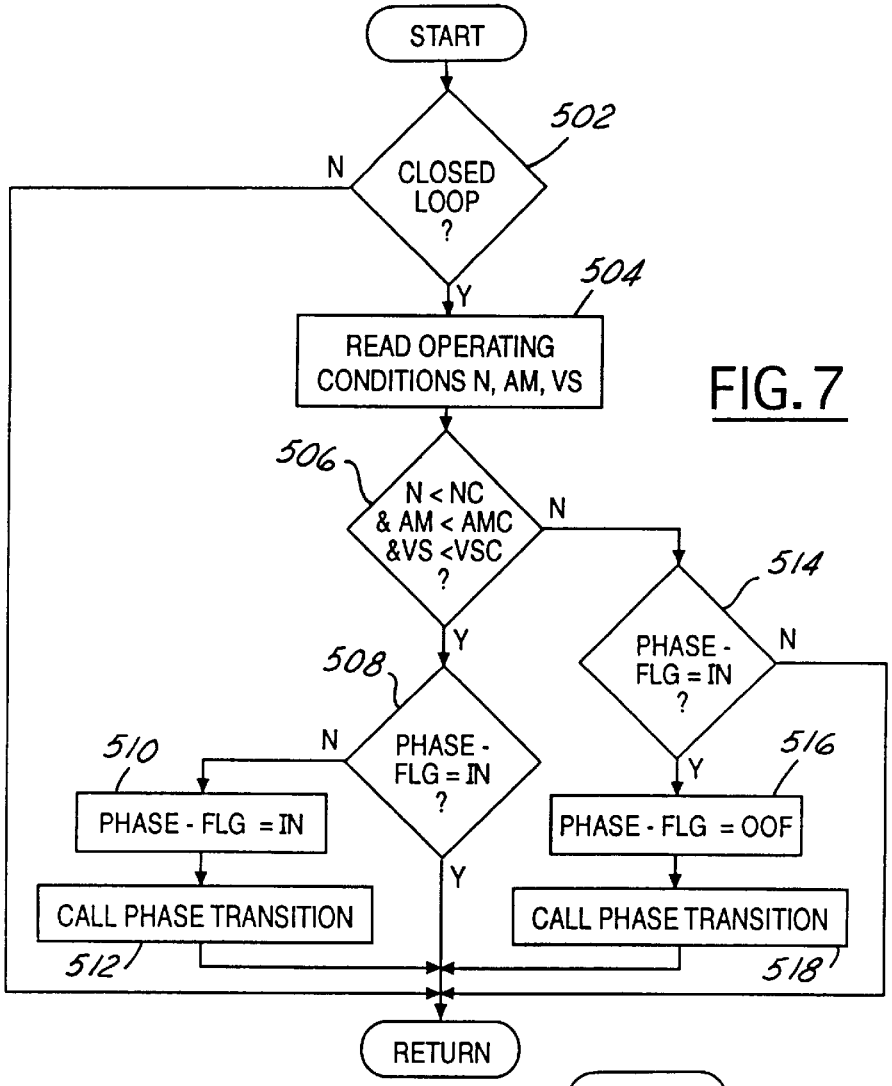

The routine for generating the desired phase signal is now described with reference to the routine shown in FIG. 7. After closed-loop air/fuel control is determined in step 502, engine operating conditions such as engine speed (RPM), engine airflow (MAF) and vehicle speed (VS) are read (step 504). In step 506, a determination is made whether the vehicle is in a condition where catalytic converter space velocities are low and driver perception is heightened, in which case a determination is made whether phase_flg is properly set (step 508). If not, in step 510 phase_flg is set to IN (in phase) and in step 512 the phase transition subroutine is called. If in step 506, it is determined that the vehicle is not in a condition where out of phase operation is desired, then in step 514 flag phase_flg is checked. If phase_flg is not properly set, phase_flg is set to OOF (out of phase) in step 516 and the phase transition routine is called in step 518. This allows the catalytic converter efficiency to be maximized for cases where large amounts of regulated compounds are entering the catalytic converter and where torque fluctuations are imperceptible. At the same time, this allows the torque fluctuations to be minimized when driver perception is heightened and emissions impacts are insignificant.

Figure 8:
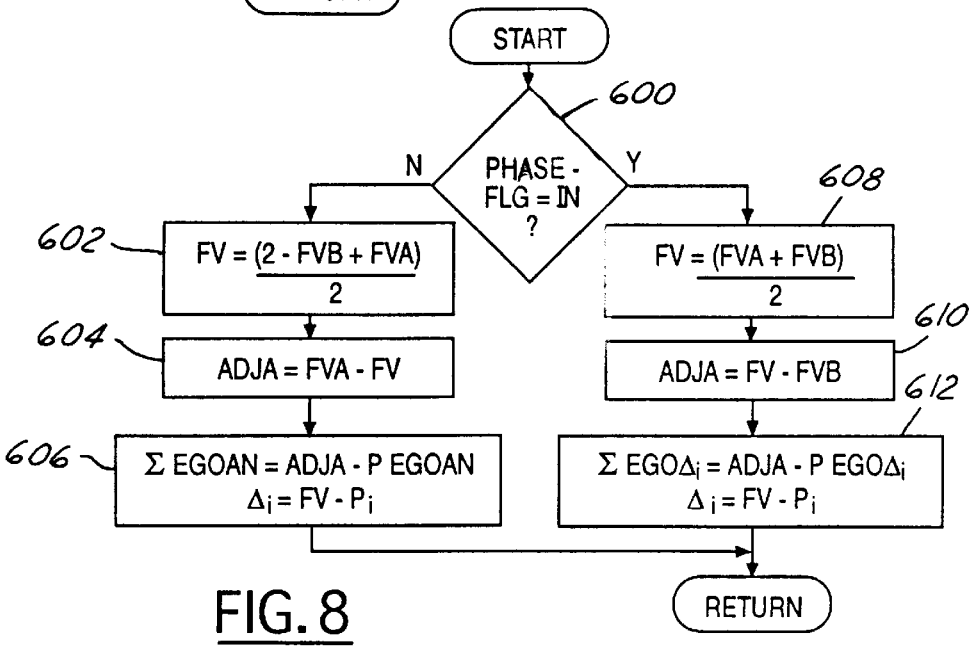

The phase transition routine for transitioning from out of phase to in phase or from in phase to out of phase is now described with reference to the routine shown in FIG. 8. When transitioning from in phase to out of phase (step 600), in step 602, feedback value FV is recalculated by subtracting FVB from the sum of FVA and 2 and dividing the whole quantity by 2. Then, adjustment signal ADJA is generated in step 604 by subtracting feedback variable FV from feedback variable FVA. Then, in step 606 integral of signal EGOAN is recalculated as the difference between adjustment signal ADJA as previously calculated in step 604 and proportional product term PEGOAN. Also, integral term Di is recalculated by subtracting proportional term Pi from feedback variable FV. When transitioning from out of phase in phase (step 600), in step 608, feedback value FV is recalculated by averaging feedback variables FVA and FVB. Then, adjustment signal ADJ is generated in step 610 by subtracting feedback variable FVB from feedback variable FV. Then, in step 612 integral of signal EGO is recalculated as the difference between adjustment signal ADJ as previously calculated in step 610 and proportional product term PEGODi. Also, integral term Di is recalculated by subtracting proportional term Pi from feedback variable FV.

This recalculation of the proportional and integral control terms when transitioning from one phase to another eliminates unnecessary fueling errors caused by a fueling bias. For example, when unequal fuel bias errors occur between the two banks of the engine, these biasing errors must be re-learned when transitioning between phases. However, because the error is known, by properly resetting the integral terms, the correct control action is taken by the controller immediately, and the need to re-learn errors is avoided. Thus, fueling errors are minimized.

Although one example of an embodiment which practices the invention has been described herein, there are numerous other examples which could also be described. For example, the invention may be used to advantage with carbureted engines proportional exhaust gas oxygen sensors, and engines having an in-line configuration rather than a V-configuration. Also, the exhaust system may be configured such that the exhaust gases from one group of cylinders pass through a first catalytic converter before joining exhaust gases from another group of cylinders that pass through a second catalytic converter. Then, both gases would be joined and pass through a third catalytic converter together. Further, other combinations of analog devices or discrete IC's may be used to advantage in place of the microcomputer shown. The invention is therefore to be defined only in accordance with the following claims.

We claim:

1. An air/fuel ratio control method for an engine having a first and second group of engine cylinders coupled to a single catalytic converter, the method comprising:

controlling air/fuel ratio of the first group of engine cylinders to oscillate about a desired air/fuel ratio;

controlling air/fuel ratio of the second group of engine cylinders to oscillate about said desired air/fuel ratio;

operating said air/fuel ratio oscillations of the first and second group of engine cylinders in phase when a first set operating conditions are detected; and operating said air/fuel ratio oscillations of the first and second group of engine cylinders out of phase when a second set operating conditions are detected.

2. The method recited in claim 1 wherein said out of phase operation further comprises the step of enabling said out of phase operation when engine speed is below a first predetermined engine speed.

3. The method recited in claim 1 wherein said in phase operation further comprises the step of enabling said in phase operation when engine speed is above a second predetermined engine speed.

4. An air/fuel ratio control system for an engine having a first and second group of engine cylinders coupled to a single catalytic converter, the system comprising:

a first air/fuel ratio controller to oscillate air/fuel ratio of the first cylinder group about a desired air/fuel ratio;

a second air/fuel ratio controller to oscillate air/fuel ratio of the second cylinder group about said desired air/fuel ratio; and a phase controller for operating said first cylinder group oscillations in phase with said second cylinder group oscillations when a first set of operating conditions are detected and operating said first cylinder group oscillations out of phase with said second cylinder group oscillations when a second set of operating conditions are detected.

5. The system recited in claim 4 wherein said phase controller further operates said first cylinder group oscillations out of phase with said second cylinder group oscillations when engine speed is below a first predetermined engine speed, air mass flow is below a first predetermined air mass flow, and vehicle speed is below a first predetermined vehicle speed.

6. The system recited in claim 4 further wherein said phase controller further operates said first cylinder group oscillations in phase with said second cylinder group oscillations when engine speed is above a second predetermined engine speed, air mass flow is above a second predetermined air mass flow, and vehicle speed is above a second predetermined vehicle speed.

7. The system recited in claim 4 wherein said first air/fuel ratio controller further comprises a controller having a first proportional term and a first integral term to oscillate air/fuel ratio of the first cylinder group about said desired air/fuel ratio and said second air/fuel ratio controller further comprises a second controller having a second proportional term and a second integral term to oscillate air/fuel ratio of the second cylinder group about said desired air/fuel ratio.

8. The system recited in claim 7 wherein said phase controller further transitions between operating said first cylinder group oscillations in phase with said second cylinder group and operating said first cylinder group oscillations out of phase with said second cylinder group by recalculating said first integral term of said first air/fuel ratio controller and recalculating said second integral term of said second air/fuel ratio controller.

9. The system recited in claim 4 further comprising a first and second sensor each respectively communicating with combustion exhaust from the first and second group of cylinders and wherein said first air/fuel ratio controller further comprises a controller having a first proportional term and a first integral term responsive to said first and second sensors to oscillate air/fuel ratio of the first cylinder group about said desired air/fuel ratio and said second air/fuel ratio controller further comprises a second controller having a second proportional term and a second integral term responsive to said second sensor to oscillate air/fuel ratio of the second cylinder group about said desired air/fuel ratio.

10. An air/fuel ratio control system for an engine having a first and second group of engine cylinders coupled to a single catalytic converter, the system comprising:

a first and second sensor each respectively coupled to the first and second group of cylinders;

a first air/fuel ratio controller having a first proportional term and a first integral term responsive to the first and second sensor to oscillate actual air/fuel ratio of the first cylinder group about a desired air/fuel ratio;

a second air/fuel ratio controller having a second proportional term and a second integral term responsive to the second sensor to oscillate actual air/fuel ratio of the second cylinder group about said desired air/fuel ratio; and a phase controller for operating said first cylinder group oscillations in phase with said second cylinder group oscillations when a first set operating conditions are detected, operating said first cylinder group oscillations out of phase with said second cylinder group oscillations when a second set of operating conditions are detected, and transitioning between operating said first cylinder group oscillations in phase and with said second cylinder group oscillations and out of phase with said second cylinder group oscillations by recalculating said first integral term of said first air/fuel ratio controller and recalculating said second integral term of said second air/fuel ratio controller.

11. The system as recited in claim 10 wherein said phase controller further operates said first cylinder group oscillations out of phase with said second cylinder group oscillations when engine speed is below a first predetermined engine speed, air mass flow is below a first predetermined air mass flow, and vehicle speed is below a first predetermined vehicle speed.

12. The system recited in claim 11 further wherein said phase controller further operates said first cylinder group oscillations in phase with said second cylinder group oscillations when engine speed is above a second predetermined engine speed, air mass flow is above a second predetermined air mass flow, and vehicle speed is above a second predetermined vehicle speed.

* * * * *

(Also Form PTO-1050)

UNITED STATES PATENT AND TRADEMARK OFFICE

CERTIFICATE OF CORRECTION

PATENT NO : 5,954,039

DATED : 09/21/99

INVENTOR(S) : Jeffrey Allen Doering; Allan Joseph Kotwicki; Brent Edward Sealy

It is certified that error appears in the above-identified patent and that said Letters Patent are hereby corrected as shown below:

Column 1, line 19, delete "separate" and insert --common--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*